United States Patent [19]

Wilson

[11] 4,143,422

[45] Mar. 13, 1979

[54] STRING TIE AND ORNAMENTAL FASTENING

[76] Inventor: Arland W. Wilson, R.R. 2, Davenport, Iowa 52804

[21] Appl. No.: 823,957

[22] Filed: Aug. 12, 1977

[51] Int. Cl.[2] ..... A41D 25/04

[52] U.S. Cl. ..... 2/145

[58] Field of Search ..... 2/144, 145, 152 R, 152 A, 2/137, 150; 24/49 R, 49 P, 49 K, 49 M, 49 A, 65, 495

[56] References Cited

U.S. PATENT DOCUMENTS

| | | | |
|---|---|---|---|
| 3,538,510 | 11/1970 | Davis, Sr. | 2/152 R |
| 3,958,277 | 5/1976 | Grirdle | 2/153 |
| 4,059,853 | 11/1977 | Grirdle | 2/152 A |

FOREIGN PATENT DOCUMENTS

| | | | |
|---|---|---|---|
| 1192548 | 4/1959 | France | 2/152 R |

*Primary Examiner*—Werner H. Schroeder
*Assistant Examiner*—Doris L. Troutman
*Attorney, Agent, or Firm*—Glenn H. Antrim

[57] ABSTRACT

A necktie ornament is bent at the seam of a man's collar for a close fit and has strings of beads attached to its lower edge to hang as a necktie down the front of a man's shirt. A spring wire for a clasp extends from the lower edge of the ornament upwardly over the front of the ornament, and its upper end is bent over the top of the ornament to provide a loop adjacent the back of the ornament for fastening to a man's collar. The upper ends of the strings of beads are anchored within a hole in the lower portion of the ornament.

5 Claims, 7 Drawing Figures

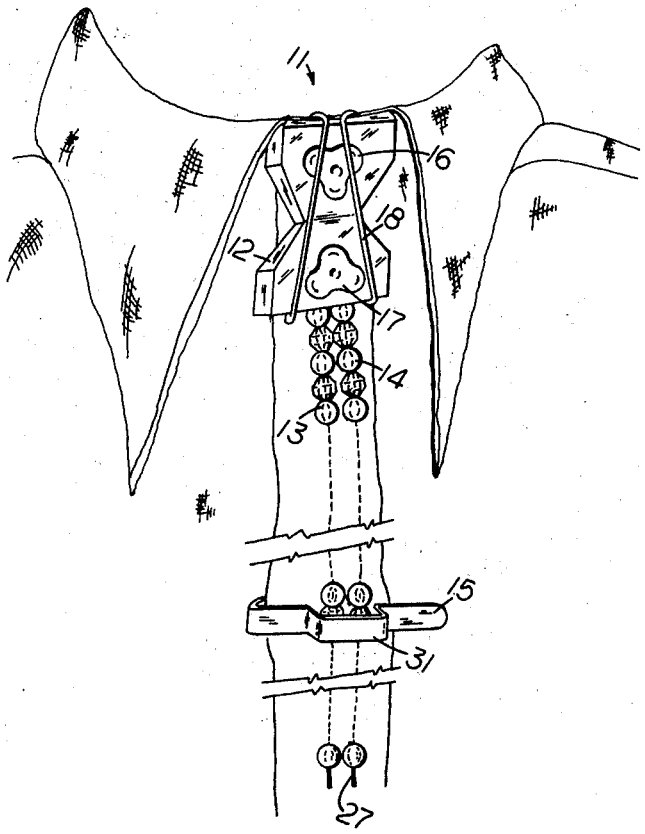

STRING TIE AND ORNAMENTAL FASTENING

BACKGROUND OF THE INVENTION

This invention relates to neckties having decorative strings and particularly to ties having ornaments for securing strings of beads to collars of shirts.

Although the neckties worn by men are most commonly four-in-hand, many prefer for variety to wear string ties. String ties can either be tied into bows at the fronts of collars of shirts or can be permitted to hang down the fronts of the shirts in somewhat the same manner as the wider four-in-hands. Many of the ties have clasps that fasten over the front of the collar of the wearers so that a new knot does not have to be made each time that a tie is worn. The clasps are usually not ornamental but are covered by the materials from which the ties are made.

SUMMARY OF THE INVENTION

A necktie according to this invention has an ornament to be fastened to the front of the collar of a man's shirt and strings of beads fastened to the ornament to hang down the front of the shirt. In size and placement, the ornament resembles a woman's brooch, but it has a different clasp that is suitable for fastening over the collar of the man's shirt. In addition to being ornamental like a brooch, the ornament has strings of beads of about the same length as a usual necktie, for example, two strings of beads fastened to the lower edge of the ornament and hanging down from the front of the man's shirt.

The ornament is bent on a lateral line at a position corresponding to the seam of a shirt collar so that the upper portion of the ornament is positioned in a direction along the neck of the wearer, and the lower portion is positioned in a direction along the chest of the wearer. The strings for the beads are threaded upwardly through separate bores from the lower edge of the ornament to a hole that is in the face of the ornament. Preferably, the strings are then threaded through a small rubber piece to anchor the upper ends of the strings. To provide a desirable appearance, a single bead is secured over the hole in which the strings of beads are anchored.

A clasp comprises a loop of spring material that has its ends embedded in the lower edge of the ornament. From the lower edge, the spring material is bent upwardly over the front of the ornament, and the upper end is bent over the upper edge such that the loop at the upper end is directed downwardly against the back of the ornament. The tension of the spring material urges the loop forwardly into a depression that is provided in the upper portion of the back of the ornament. Since the middle portion of the spring wire is spaced from the front of the ornament, pressure can be applied at the middle portion to force the loop rearwardly to provide space between the ornament and the loop while positioning the loop over and back of the top rim of the collar. When the pressure applied to the spring wire is released, the tendency of the loop to force the collar into the depression at the back of the ornament secures the ornament to the front of the collar. A special tie clasp for the strings of beads is clipped to the front of the shirt in a usual manner. The bead that is placed over the hole in the lower portion of the ornament where the strings of the beads are anchored can be selected for desired shape and color, and preferably a matching bead is placed on the face of the upper portion of the ornament that is along the neck of the wearer.

DESCRIPTION OF THE PREFERRED EMBODIMENT

Figure 1:
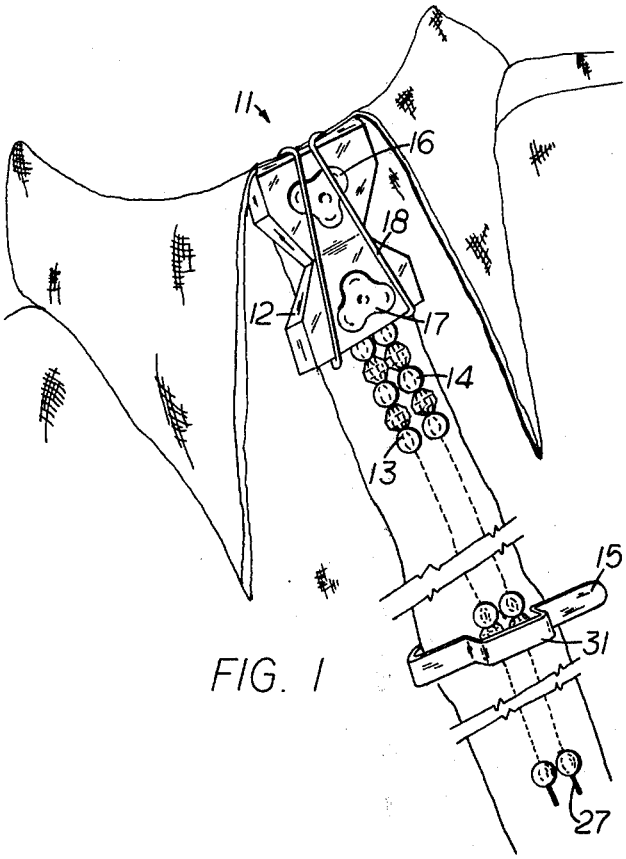
FIG. 1 is a perspective view of the necktie of this invention connected to the collar of a man's shirt.

The necktie 11 of FIG. 1 has an ornamental member 12 connected to the collar of a man's shirt and two strings of beads 13 and 14 hanging closely together from the ornamental member 12 down the front of the man's shirt. A tie clasp 15 with a raised central portion for containing the strings of beads 13 and 14 is fastened to the shirt front in the usual manner. The particular ornamental member 12 of FIG. 1 is shaped to have decreased width in the central portion on a line that is about even with the seam of the collar of the shirt. The ornamental member is also bent or curved on this line such that an upper portion is positioned in the direction of the neck of a wearer, and the lower portion is positioned in the direction of the chest of the wearer. The upper and lower portions of the ornamental member 12 have on their faces centrally located, decorative beads 16 and 17 respectively.

Figure 2:
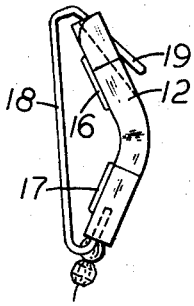
FIG. 2 is a side view of the ornament of the necktie.

The angle at which the ornamental member 12 is bent on a transverse line through its central portion and the shape of a spring wire 18 that functions as a clasp can be seen in FIG. 2. The spring wire 18 extends from the bottom edge of the ornamental member 12, up across the face of the ornamental member, and has a loop 19 as shown in FIGS. 4 and 5 urged inwardly against the upper, central portion of the back of the ornamental member 12.

The ornamental member 12 may be cut from lightweight, transparent, thermoplastic resin commonly known by the trademark Plexiglass. The piece of Plexiglass is first cut in the outline desired, then has holes drilled for securing beads, is ground to provide a depression in its back surface for the loop 19 of the spring wire 18, has its upper corners beveled, and has the spring wire 18 attached for a clasp. A piece of material 20 of FIG. 3 for the ornamental member 12 has a rather shallow hole 21 drilled by the usual twist drill in the center of the upper portion of the ornamental member and a deeper hole 22 in about the center of the lower portion of the ornamental member. Preferably, the bottom of the hole 22 is completed by a drill with a flat point such that a hole of maximum depth may be obtained without passing completely through the material 20. Two bores 23, having a diameter slightly greater than the diameter of a string for the beads 13 and 14, are drilled upwardly from the lower edge of the piece 20 to the hole 22. The lower ends of the bores 23 are countersunk to receive a portion of the top beads of the strings of beads 13 and 14.

Figure 4:
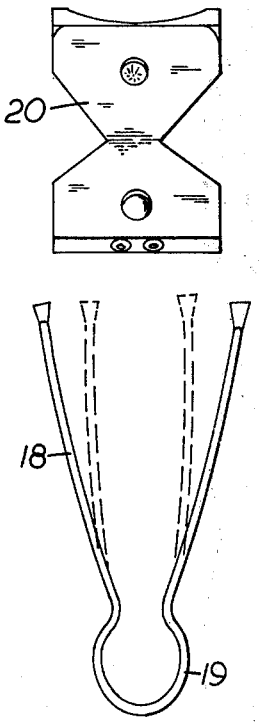
FIG. 4 shows a front view of the piece of material and a spring wire that is to be attached to the lower edge of the ornament and bent to form a clasp.
Figure 5:
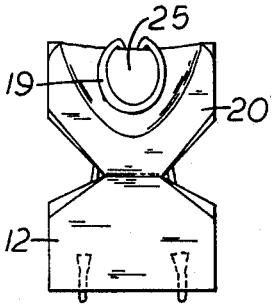
FIG. 5 is a rear view of the ornament after the spring wire is attached.

With reference to FIG. 4, a piece of spring wire 18 is formed to have a central loop 19 and a pair of slightly diverging legs of equal length. The legs are to be inserted in the bottom edge of the piece 20, and the ends of the legs are flattened somewhat to prevent turning. Before the legs of the spring wire 18 are attached to the piece 20, they are spread farther apart than normal to provide outward spring tension after the legs are secured to the piece. The legs of the spring wire 18 are brought together to the desired position and held in a clamp in preparation for their assembly to the piece 20. The legs are then heated to almost a red heat, and the lower portion of the piece 20 is also heated somewhat. The lower edge of the piece 20 is then placed against the heated ends of the spring wire 18 and is pressed firmly so that the ends of the spring wire 18 enter the piece 20 for a distance of about 154 inch (0.96 cm). After the assembly has cooled, the spring wire 18 is bent sharply about the lower edge of the piece 20 and then upwardly over the front of the piece and then over its top edge.

Figure 6:
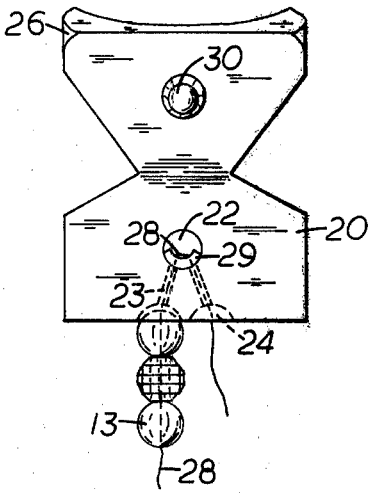
FIG. 6 is an enlarged front view of the ornament to show attachment of the strings of beads.

The loop 19 is positioned adjacent the back of the upper portion of the piece 20 such that tension of the spring urges the loop 19 tightly against the back. Either before or after the piece is bent, a central curved depression 25 (FIG. 5) is ground in the upper portion of the back of the piece 20 for receiving the loop 19. In this manner, the loop 19 tends to press the collar of a shirt to which the ornament is attached into the depression to hold the necktie 11 securely. As shown in FIG. 6, the front, upper corners 26 of the piece 20 are beveled such that the ornament does not have a tendency to catch on the collar of the wearer.

Figure 3:
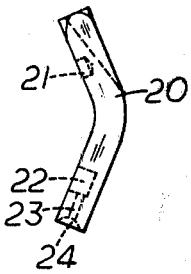
FIG. 3 shows a piece of material for the main part of the ornament after a drilling and a bending operation.

The beads of the two strings of beads 13 and 14 are preferably threaded on a single string. A small tubular retainer 27 of FIG. 1 is first clamped to an end of the string 28 of FIG. 6, and then the string is threaded through the beads for one of the strands such as the strand 13. The string 28 is then threaded through one of the bores 23, upwardly and then downwardly through a small piece of rubber 29 for anchoring the strings of beads, and downwardly through the other bore 23. The string 28 is then threaded through the beads for the remaining string of beads 14, and while the beads are held tightly so that the upper beads of the strings enter the countersinks 24, another small tubular retainer 27 is clamped to the end of the string below the beads 14. Either flat beads or ornaments 16 and 17 as shown in FIG. 1 or beads that are generally round such as bead 30 of FIG. 6 can be attached by adhesive to the front surface of the ornamental member 12. When the beads are flat, the upper hole 21 for securing a round bead as shown in FIG. 3 is not necessary. The lower flat bead 17, or a round bead, covers the hole 22 in which the strings of beads 13 or 14 are anchored.

Figure 7:
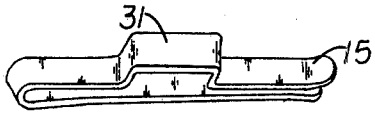
FIG. 7 is a perspective view of a suitable tie clasp to hold the strings of beads in place down the front of a shirt.

The tie clasp 15 of FIGS. 1 and 7 has a central U-shaped portion 31 in the front part of the clasp to fit over the strings of beads 13 and 14. Other than the central U-shaped portion, the clasp is the conventional folded piece of string material of decorative appearance.

The beads of the strings of beads 13 and 14 may be alternate contrasting colors, and the decorative beads 16 and 17 on the front face of the ornamental member 12 may match one of the colors selected for the strings 13 and 14. The necktie 11 is easily attached to the collar by placing a thumb back of the central portion of the ornamental member 12 and placing a forefinger across the two legs of the spring wire 18. While the thumb and forefinger are pressed together, the loop 19 becomes spaced sufficiently from the back of the ornamental member 12 to permit the loop 19 to be positioned inside the collar of the wearer, and likewise, the tension can be relieved to remove the necktie 11.

I claim:

1. A necktie having an ornamental member and a string tie attached to said ornamental member, said ornamental member to be fastened to the front of a collar of a garment, said ornamental member being fabricated of rigid material of moderate thickness, a clasp attached to said ornamental member, said clasp having a fastening portion extending from the top of said ornamental member downwardly along the back of the upper portion of said ornamental member for gripping a collar between said upper portion of said ornamental member and said fastening portion, said clasp being a wire of spring material having an end secured to the bottom edge of said ornamental member, said wire being bent at said end thereof and extending upwardly over the front of said ornament, and a portion of said wire that is opposite said end being bent over the top of said ornamental member to form said fastening portion.

2. A necktie as claimed in claim 1 wherein said upper back portion of said ornamental member has a depression, and said wire urging said fastening portion into said depression.

3. A necktie having an ornamental member and a string of beads attached to said ornamental member, said ornamental member to be fastened to the front of a collar of a garment, said ornamental member being fabricated of rigid material of moderate thickness, a clasp attached to said ornamental member, said clasp having a fastening portion extending from the top of said ornamental member downwardly along the back of the upper portion of said ornamental member for gripping a collar between said upper portion of said ornamental member and said fastening portion, said string of beads being anchored within a hole in one side of said ornamental member, said hole being in a lower portion of said ornamental member and said lower portion having a bore extending from said hole through the lower edge of said ornamental member, the diameter of said bore being greater than the diameter of the string of said string of beads, and tying means for anchoring said string of beads within said hole.

4. A necktie as claimed in claim 3 wherein said tying means includes within said hole a piece of rubberlike material through which said string of beads is threaded.

5. A necktie as claimed in claim 3 wherein a decorative bead is positioned over said hole in said side of said ornamental member.

* * * * *